US010398952B1

(12) United States Patent
Yi et al.

(10) Patent No.: US 10,398,952 B1
(45) Date of Patent: Sep. 3, 2019

(54) GOLF CLUB HAVING MOVABLE WEIGHT

(71) Applicant: Acushnet Company, Fairhaven, MA (US)

(72) Inventors: Sang Yi, Carlsbad, CA (US); Richard L. Cleghorn, Oceanside, CA (US)

(73) Assignee: Acushnet Company, Fairhaven, MA (US)

( * ) Notice: Subject to any disclaimer, the term of this patent is extended or adjusted under 35 U.S.C. 154(b) by 0 days.

(21) Appl. No.: 16/029,386

(22) Filed: Jul. 6, 2018

(51) Int. Cl.

| | |
|---|---|
| ***A63B 53/06*** | (2015.01) |
| ***A63B 53/04*** | (2015.01) |
| ***A63B 53/08*** | (2015.01) |
| *A63B 60/42* | (2015.01) |
| *A63B 102/32* | (2015.01) |

(52) U.S. Cl.
CPC ..... *A63B 53/06* (2013.01); *A63B 53/0466* (2013.01); *A63B 53/08* (2013.01); *A63B 60/42* (2015.10); *A63B 2053/0408* (2013.01); *A63B 2053/0437* (2013.01); *A63B 2053/0491* (2013.01); *A63B 2102/32* (2015.10)

(58) Field of Classification Search
CPC ..... A63B 53/06; A63B 53/08; A63B 53/0466; A63B 2053/0437; A63B 2102/32; A63B 60/42; A63B 2053/0491; A63B 2053/0408
See application file for complete search history.

(56) References Cited

U.S. PATENT DOCUMENTS

| | | | | |
|---|---|---|---|---|
| 5,720,674 | A | 2/1998 | Galy | |
| 7,147,573 | B2 | 12/2006 | DiMarco | |
| 7,186,190 | B1 | 3/2007 | Beach et al. | |
| 7,452,286 | B2 | 11/2008 | Lin et al. | |
| 8,206,243 | B2 | 6/2012 | Stites | |
| 8,894,506 | B1 * | 11/2014 | Myers | A63B 53/0466 473/334 |
| 9,289,660 | B1 | 3/2016 | Myers | |
| 9,364,728 | B1 | 6/2016 | Myers et al. | |
| 9,364,729 | B2 * | 6/2016 | Myers | A63B 53/0466 |
| 10,183,203 | B1 * | 1/2019 | Yi | A63B 53/0466 |
| 10,213,665 | B1 * | 2/2019 | Day | A63B 53/06 |
| 2006/0240908 | A1 | 10/2006 | Adams et al. | |

* cited by examiner

*Primary Examiner* — Stephen L Blau
(74) *Attorney, Agent, or Firm* — Randy K. Chang

(57) ABSTRACT

A golf club head is presented comprising a sole including a weight member that is slidable in an elongate weight mount including a rail. The weight member is rotatable about the rail between an unlocked orientation and a locked orientation.

18 Claims, 7 Drawing Sheets

GOLF CLUB HAVING MOVABLE WEIGHT

FIELD OF THE INVENTION

The invention relates to golf clubs, and more particularly, to golf club heads having a movable weight.

BACKGROUND OF THE INVENTION

The trend of lengthening golf courses to increase their difficulty has resulted in a high percentage of amateur golfers constantly searching for ways to achieve more distance from their golf shots. The golf industry has responded by providing golf clubs specifically designed with distance and accuracy in mind. The size of wood-type golf club heads has generally been increased while multi-material construction and reduced wall thicknesses have been included to provide more mass available for selective placement through the head. The discretionary mass placement has allowed the club to possess a higher moment of inertia (MOI), which translates to a greater ability to resist twisting during off-center ball impacts and less of a distance penalty for those off-center ball impacts.

Various methods are used to selectively locate mass throughout golf club heads, including thickening portions of the body casting itself or strategically adding separate weight element during the manufacture of the club head. An example, shown in U.S. Pat. No. 7,186,190, discloses a golf club head comprising a number of moveable weights attached to the body of the club head. The club head includes a number of threaded ports into which the moveable weights are screwed. Though the mass characteristics of the golf club may be manipulated by rearranging the moveable weights, the cylindrical shape of the weights and the receiving features within the golf club body necessarily moves a significant portion of the mass toward the center of the club head, which may not maximize the peripheral weight of the club head or the MOI.

Alternative approaches for selectively locating mass in a club head utilize composite multi-material structures. These composite structures utilize two, three, or more materials that have different physical properties including different densities. An example of this type of composite club head is shown in U.S. Pat. No. 5,720,674. The club head comprises an arcuate portion of high-density material bonded to a recess in the back-skirt. Because composite materials like those found in the club head must be bonded together, for example by welding, swaging, or using bonding agents such as epoxy, they may be subject to delamination or corrosion over time. This component delamination or corrosion results in decreased performance in the golf club head and can lead to club head failure.

Further alternatives include a weight that is positioned within a channel formed in a golf club head. Generally, the weight must be inserted into an enlarged portion of the channel and then a plug inserted so that the weight is not ejected from the channel during use.

Though many methods of optimizing the mass properties of golf club heads exist, there remains a need in the art for a golf club head comprising at least a removable weight having secure attachment and a low-profile so that the weight does not protrude into the center of the club head and negatively affect the location of the center of gravity.

SUMMARY OF THE INVENTION

The present invention is directed to a golf club head having a portion comprising at least one movable weight member. The movable weight member is preferably structured so that it can be locked into multiple locations in a weight mount.

In an embodiment, a golf club head comprises a hosel, a ball striking face, a sole, a crown, a skirt, a weight mount, and a weight member. The sole extends aftward from a lower edge of the ball striking face. The crown extends aftward from an upper edge of the ball striking face. The skirt extends between the sole and the crown. The weight mount is disposed on at least one of the sole, the crown and the skirt, and includes a sidewall, an elongate rail, and a mount locking feature disposed on the sidewall. The rail defines a longitudinal axis extending parallel to the rail, and is suspended away from the sidewall by a plurality of rail supports spaced by a distance $D_1$. At each of at least two locations along the rail the weight mount defines a first radial dimension $R_{L1}$ between the center of the rail and the sidewall, and a second radial dimension $R_{L2}$ between the center of the rail and the sidewall, and the magnitude of $R_{L1}$ is greater than the magnitude of $R_{L2}$. The weight member includes a first slot and a second slot. The first slot includes an opening and a cavity that receives the rail at the innermost end of the first slot. The second slot extends into the weight member to define a cantilevered lock tab that has a width $D_2$, and the width $D_2$ is less than distance $D_1$ between adjacent rail supports. The lock tab includes an outer surface that defines a weight locking feature. The weight member defines a radial dimension $R_{W1}$ between a center of the cavity and the outermost portion of the weight locking feature, and when the weight member is in a free state the magnitude of $R_{W1}$ is greater than the magnitude of $R_{L2}$. The weight member is rotatable about the rail between an unlocked orientation and a locked orientation, wherein in the unlocked orientation the first slot is aligned with the rail supports so that the weight member is slidable along the rail in the direction of the longitudinal axis of the rail. In the locked orientation, the lock tab of the weight member extends into the space defined by adjacent rail supports to prevent movement of the weight member longitudinally along the rail and the lock tab abuts the sidewall of the mount so that the weight locking feature forcibly engages the mount locking feature to prevent rotation of the weight member about the rail. The magnitude of the radial dimension $R_{W1}$ of the weight member changes when the weight member is rotated between the unlocked orientation and the locked orientation such that the magnitude of $R_{W1}$ is smaller when the weight member is in the locked orientation than when the weight member is in the free state.

In another embodiment, a golf club head comprises a hosel, a ball striking face, a sole, a crown, a skirt, a weight mount, and a weight member. The sole extends aftward from a lower edge of the ball striking face. The crown extends aftward from an upper edge of the ball striking face. The skirt extends between the sole and the crown. The weight mount is disposed on at least one of the sole, the crown and the skirt, and the weight mount includes a sidewall, an elongate rail, a tool engagement feature, and a mount locking feature disposed on the sidewall that is a ridge that projects from the sidewall of the weight mount. The rail defines a longitudinal axis extending parallel to the rail, and the rail is suspended away from the sidewall by a plurality of rail supports and adjacent rail supports are spaced by a distance $D_1$. At each of at least two locations along the rail the weight mount defines a first radial dimension $R_{L1}$ between the center of the rail and the sidewall, and a second radial dimension $R_{L2}$ between the center of the rail and the sidewall, and a magnitude of $R_{L1}$ is greater than a magnitude of $R_{L2}$. The weight member includes a first slot and a second slot. The first slot defines an opening and a cavity that receives the rail at the innermost end of the first slot, and the second slot extends into the weight member to define a cantilevered lock tab that has a width $D_2$, and the width $D_2$ is less than distance $D_1$ between adjacent rail supports. The lock tab includes an outer surface that defines a weight locking feature that is an elongate recess that extends across the lock tab. The weight member defines a radial dimension $R_{W1}$ between a center of the cavity and the outermost portion of the weight locking feature. When the weight member is in a free state a magnitude of $R_{W1}$ is greater than the magnitude of $R_{L2}$. The weight member is selectively rotatable about the rail between an unlocked orientation and a locked orientation. In the unlocked orientation the first slot is aligned with the nearest rail supports so that the weight member is slidable along the rail in the direction of the longitudinal axis of the rail, and in the locked orientation the lock tab of the weight member extends into the space defined by adjacent rail supports to prevent movement of the weight member longitudinally along the rail and the lock tab abuts the sidewall so that the weight locking feature forcibly engages the mount locking feature to prevent rotation of the weight member about the rail. The magnitude of radial dimension $R_{W1}$ of the weight member changes when the weight member is rotated between the unlocked orientation and the locked orientation such that the magnitude of $R_{W1}$ is smaller when the weight member is in the locked orientation than when the weight member is in the free state.

In another embodiment, a golf club head comprises a hosel, a ball striking face, a sole, a crown, a skirt, a weight mount, and a weight member. The sole extends aftward from a lower edge of the ball striking face. The crown extends aftward from an upper edge of the ball striking face. The skirt extends between the sole and the crown. The weight mount is disposed on at least one of the sole, the crown and the skirt, and includes a sidewall, an elongate rail, a tool engagement feature, and a mount locking feature. The mount locking feature is disposed on the sidewall and is an elongate channel that is recessed into the sidewall of the weight mount. The rail defines a longitudinal axis extending parallel to the rail, and the rail is suspended away from the sidewall by a plurality of rail supports. Adjacent rail supports are spaced by a distance $D_1$. At each of at least two locations along the rail the weight mount defines a first radial dimension $R_{L1}$ between the center of the rail and the sidewall, a second radial dimension $R_{L2}$ between the center of the rail and the sidewall, and a third radial dimension $R_{L3}$ between the center of the rail and the elongate channel, dimension $R_{L2}$ is disposed between dimensions $R_{L1}$ and $R_{L3}$, a magnitude of $R_{L1}$ is greater than a magnitude of $R_{L3}$, and the magnitudes of $R_{L1}$ and $R_{L3}$ are greater than a magnitude of $R_{L2}$. The weight member includes a first slot and a second slot. The first slot defines an opening and a cavity that receives the rail at the innermost end of the first slot. The second slot defines a cantilevered lock tab that has a width $D_2$, and the width $D_2$ is less than distance $D_1$ between adjacent rail supports. The lock tab includes an outer surface that defines a weight locking feature that is an elongate ridge that extends across the lock tab. The weight member defines a radial dimension $R_{W1}$ between a center of the cavity and the outermost portion of the weight locking feature. The weight member is slidable on the rail and rotatable about the rail. When the weight member is in a free state a magnitude of $R_{W1}$ is greater than the magnitude of $R_{L2}$ and the magnitude of $R_u$. The weight member is selectively rotatable about the rail between an unlocked orientation and a locked orientation. In the unlocked orientation the first slot is aligned with the nearest rail supports so that the weight member is slidable along the rail in the direction of the longitudinal axis of the rail. In the locked orientation the lock tab of the weight member extends into the space defined by adjacent rail supports to prevent movement of the weight member longitudinally along the rail and the lock tab abuts the sidewall of the mount so that the weight locking feature engages the mount locking feature to prevent rotation of the weight member about the rail. The magnitude of dimension $R_{W1}$ changes when the weight member is rotated between the unlocked orientation and the locked orientation such that the magnitude of $R_{W1}$ is smaller in the locked orientation than in the free state of the weight member.

DETAILED DESCRIPTION

Other than in the operating examples, or unless otherwise expressly specified, all of the numerical ranges, amounts, values and percentages such as those for amounts of materials, moments of inertias, center of gravity locations, loft and draft angles, and others in the following portion of the specification may be read as if prefaced by the word "about" even though the term "about" may not expressly appear with the value, amount, or range. Accordingly, unless indicated to the contrary, the numerical parameters set forth in the following specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Furthermore, when numerical ranges of varying scope are set forth herein, it is contemplated that any combination of these values inclusive of the recited values may be used.

The golf club head of the present invention is preferably hollow, such as a metal wood type golf club head, but may include any club head type, such as iron-type club heads. The golf club head generally includes a hosel, a hitting face, a crown, a sole, and a skirt that combine to define a hollow interior cavity.

Figure 1:
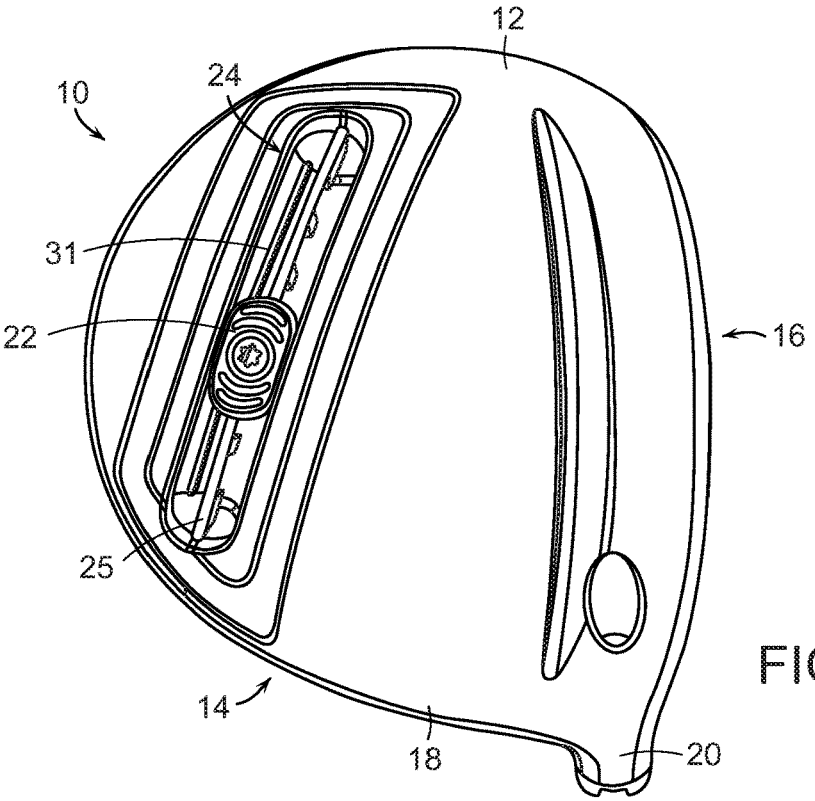
FIG. 1 is a bottom view of the sole of a golf club head including a movable weight.
Figure 2:
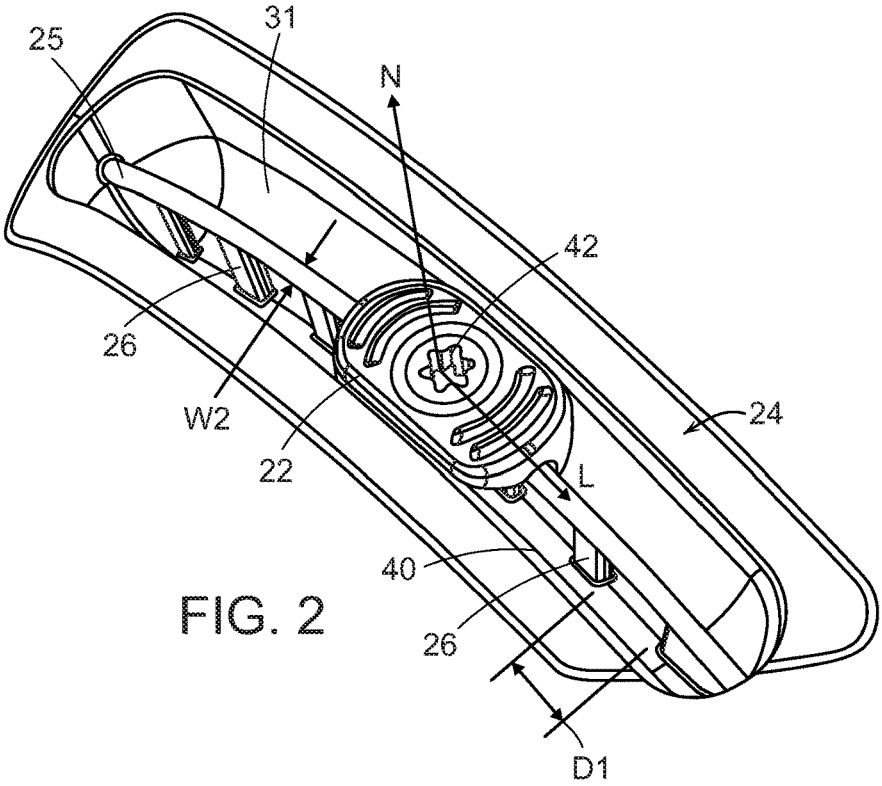
FIG. 2 is a perspective view of a portion of the golf club head of FIG. 1, including the movable weight member.
Figure 3:
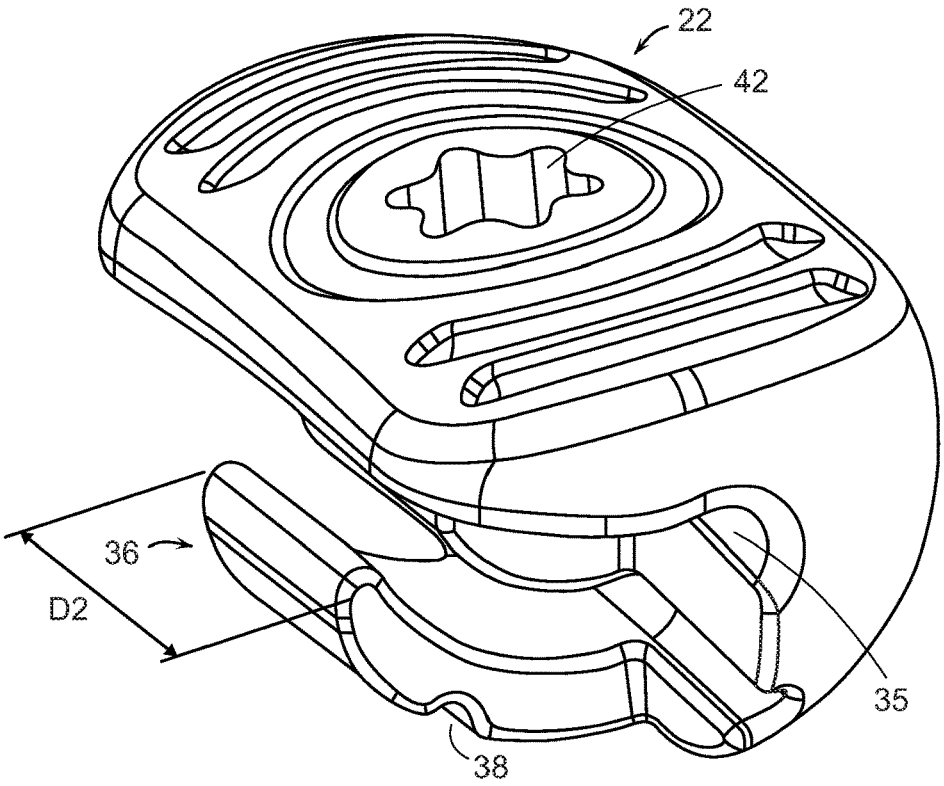
FIG. 3 is a perspective view of the movable weight member of FIG. 1.
Figure 4:
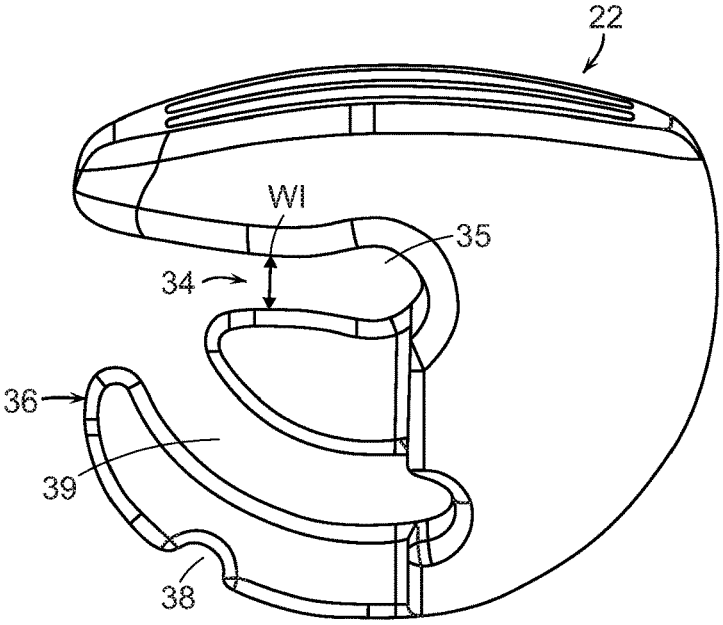
FIG. 4 is a side view of the movable weight member of FIG. 3.

An exemplary golf club head is shown in FIGS. 1 and 2. Golf club head 10 generally has a hollow, metalwood-type construction and includes a sole 12, a crown 14, a hitting face 16, a skirt 18, a hosel 20, and a weight member 22. Sole 12 generally provides the lower surface of golf club head 10 when the club head is placed in an address position. Sole 12 includes a weight mount 24, which is configured to couple the weight member 22 to the sole 12.

The weight mount 24 is generally constructed from a locking portion and a rail. In the present embodiment, weight mount 24 is an elongate recessed channel portion of the golf club head that includes a longitudinal rail 25. The recessed channel is defined by a sidewall 31 that extends from an outer surface of the golf club head toward an interior of the golf club head 10, and a portion of the sidewall 31 forms the locking portion. The sidewall 31 includes generally parallel portions and a generally curved innermost portion at the deepest portion of the channel that extends between the parallel portions. In the illustrated embodiment, the weight mount 24 is disposed on the sole 12, but it should be appreciated that the weight mount of any of the embodiments described herein may be located on any portion of the golf club head including the sole, crown, skirt, hosel, and/or face. The weight mount 24 defines an inner surface that is exposed to the exterior of the golf club head. The locking portion is defined by the curved portion of the sidewall 31 and the distance between the rail and the locking portion varies to deflect a portion of the weight member 22 as will be described in greater detail below.

The rail 25 of weight mount 24 is disposed inside the interior of the elongate recessed channel and is held in a spaced relationship relative to the sidewall of the channel. The rail 25 is suspended in the weight mount 24 by a plurality of rail supports 26 that are spaced from each other by a predetermined distance D1 that is generally based on the dimensions of the weight member 22. In the present embodiment, the rail supports 26 are coupled to a portion of the sidewall 31 that defines the locking portion. As will be described in greater detail below, the rail 25 and rail supports 26 interact with the weight member 22 to restrict relative motion between the weight member and the weight mount in directions longitudinally along the weight mount, and in a direction generally normal to the weight mount, as shown by the longitudinal ("L") and normal ("N") axes illustrated in FIG. 2, so that the weight member is retained within the weight mount. For example, the predetermined distance D1 is sized to correspond to a dimension of a portion of the weight member to restrict movement of the weight member 22 longitudinally when the weight member 22 is in a locked orientation. It should be appreciated that, as used herein, the longitudinal axis is an axis that matches any curvature of the rail.

Generally, the weight member may be rotated about the rail 25 between an unlocked orientation and a locked orientation. In the unlocked orientation, the weight member is movable along the elongate weight mount along the longitudinal axis L by sliding it along the rail. In the locked configuration, a first portion of the weight member is disposed between the nearest spaced rail supports to restrict longitudinal movement of the weight member along the rail, relative to the weight mount. Additionally, the first portion of the weight member extends between the lower wall of the weight mount and the rail to restrict relative movement between the weight member and the weight mount in a direction normal to the weight mount. Finally, a lock tab on the weight member engages the locking portion of the weight mount to provide a détente when the weight member is in the locked orientation. The force required to rotate the weight member about the rail may be tuned by altering the interaction between the locking portion of the weight mount and the weight member, and preferably is tuned to prevent the ability of a user to lock or unlock the weight member without the use of a tool. The force is also tuned to prevent the weight member from becoming unlocked during use because of the force of impact with a golf ball.

In an embodiment, the weight member 22 has a single piece construction formed from a monolithic body that is shaped to be disposed in the weight mount 24 and to engage the rail 25. Weight member 22 includes a slot 34 that receives rail 25 and is shaped so that the weight member 22 is snapped onto the rail 25, and requires additional force to remove the weight member 22 from the rail 25. The slot 34 is shaped so that after the weight member 22 is installed on the rail, the weight member 22 may be slid along the rail 25. Slot 34 generally forms an opening into a cavity 35 that receives the rail 25. The slot 34 is sized with a width $W_1$ that is about equal to the width $W_2$ of rail 25 so that the rail 25 may be forcibly slid through the slot 34 into cavity 35. As an alternative, the rail may include a reduced width portion that allows the weight member 22 to be installed at only that reduced width location.

The weight member 22 also includes a lock tab 36 that engages a locking portion of the sidewall of the weight mount 24 to lock the weight member into a location. The lock tab 36 is generally a flexible cantilevered tab defined by a second slot 39 extending into the weight member, and includes a weight locking feature, such as recess 38. It should be appreciated that the weight locking feature may be a recess or a projection, but is selected to complement a mount locking feature. The lock tab 36 also has a width D2 that is selected so that the lock tab 36 is able to extend through the spacing between adjacent rail supports 26 when the weight member is rotated between the unlocked orientation and the locked orientation. The locking portion of the sidewall of the weight mount is a portion that abuts the lock tab 36, causing the lock tab 36 to deflect, and includes the mount locking feature, such as ridge 40 that is received by recess 38. In the present embodiment, the weight locking feature is an elongate recess that receives the mount locking feature which is a ridge, but it should be appreciated that the weight locking feature may be a dimple and the mount locking feature may be a plurality of discrete projections forming a group of bumps that complement the dimple.

Additionally, it should be appreciated that, as an alternative, the recess may be included as a mount locking feature and a complementary projection may be included as the weight locking feature, as will be described in greater detail below. After the weight member 22 is installed on the rail 25, it may be rotated about the rail 25 to orient it in a locked configuration, shown in FIGS. 1 and 2, or in an unlocked orientation.

In the illustrated embodiment, the weight locking feature, recess 38, extends from an outer surface of the lock tab 36 and receives the ridge 40 that is disposed in the locking portion of the sidewall 31 of weight mount 24. The weight member 22 is preferably rotated about the rail 25 using a tool that is temporarily coupled to a tool engagement feature 42 included in weight member 22. It should be appreciated that the weight member 22 may be constructed from multiple pieces, but those pieces need not move relative to each other after the weight is constructed. For example, portions of the weight member may be constructed from pieces having different densities to alter the mass of the weight member.

Referring to FIGS. 5-10, the installation and use of another embodiment of the weight member of the present invention will be described. Alternative embodiments of the weight member and weight mount are illustrated that include additional alignment features, but are otherwise constructed similar to the weight member and weight mount of the previous embodiment. The additional alignment features indicate to the user the positions in which the weight member may be placed in the locked orientation throughout the weight mount. Similar to the previous embodiment, weight member 52 includes a slot 56 that is sized to receive and snap onto a rail 58 in the weight mount 54, and a lock tab 60.

Figure 6:
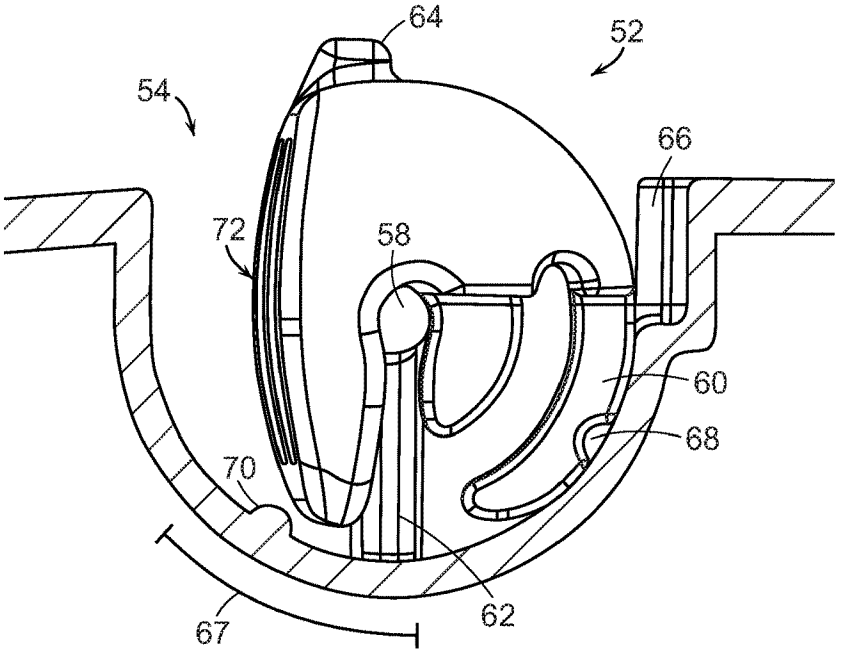
FIG. 6 is another partial cross-sectional view of the golf club head of FIG. 5, illustrating another step in the installation of the movable weight member.
Figure 5:
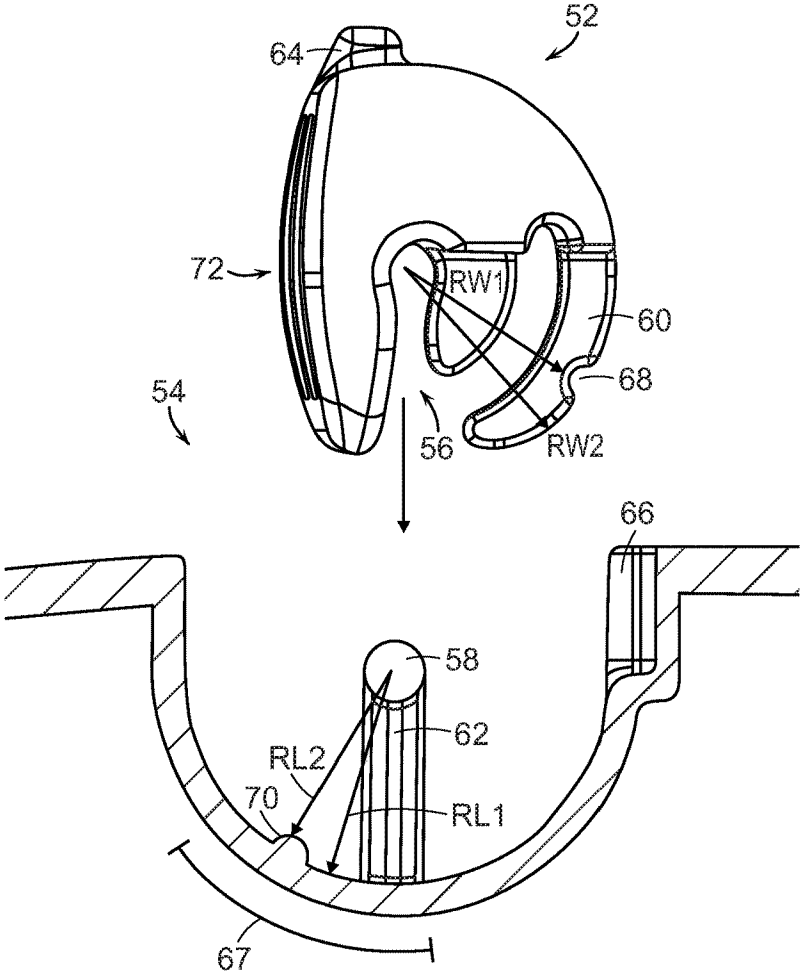
FIG. 5 is a partial cross-sectional view of a portion of another embodiment of a golf club head including a movable weight in accordance with the present invention, illustrating a step in the installation of the movable weight member.
Figure 7:
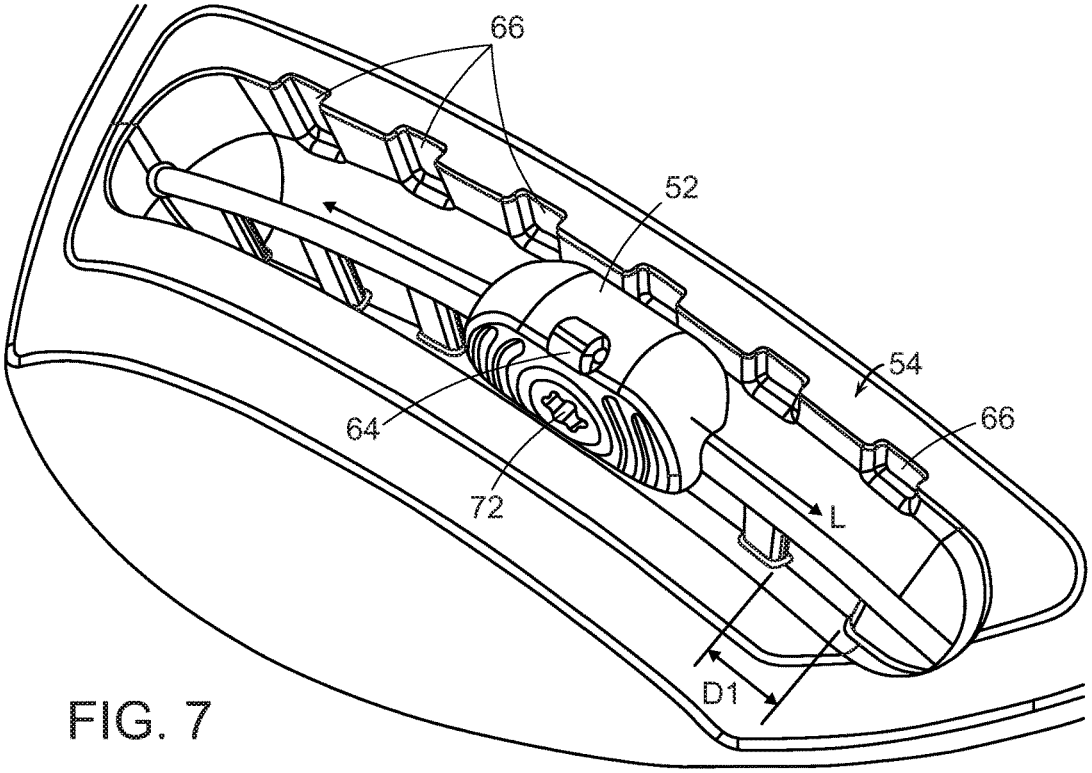
FIG. 7 is a perspective view of a portion of the golf club head of FIG. 5.
Figure 8:
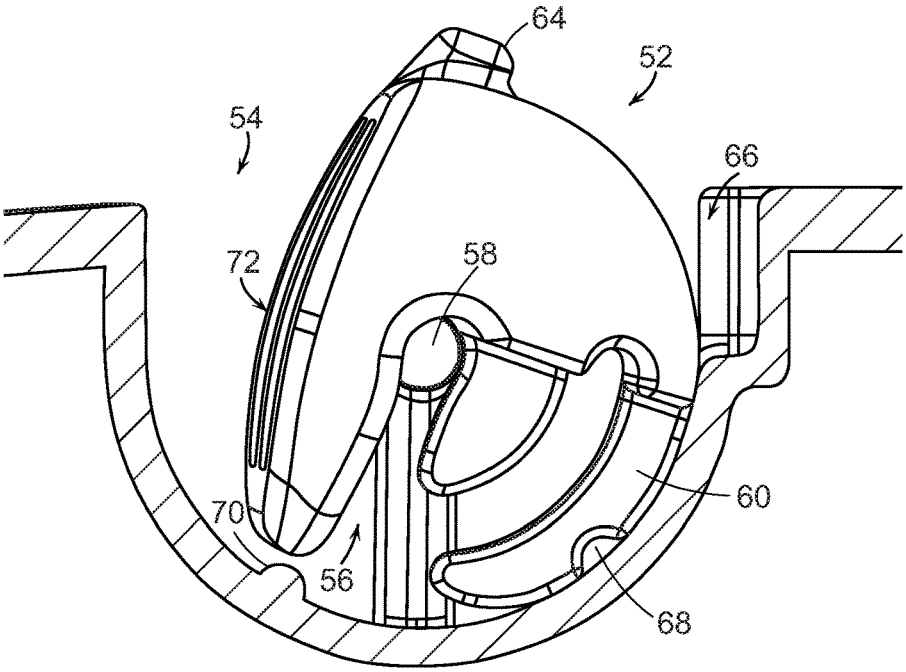
FIG. 8 is another partial cross-sectional view of the golf club head of FIG. 5, illustrating another step in the installation of the movable weight member.
Figure 9:
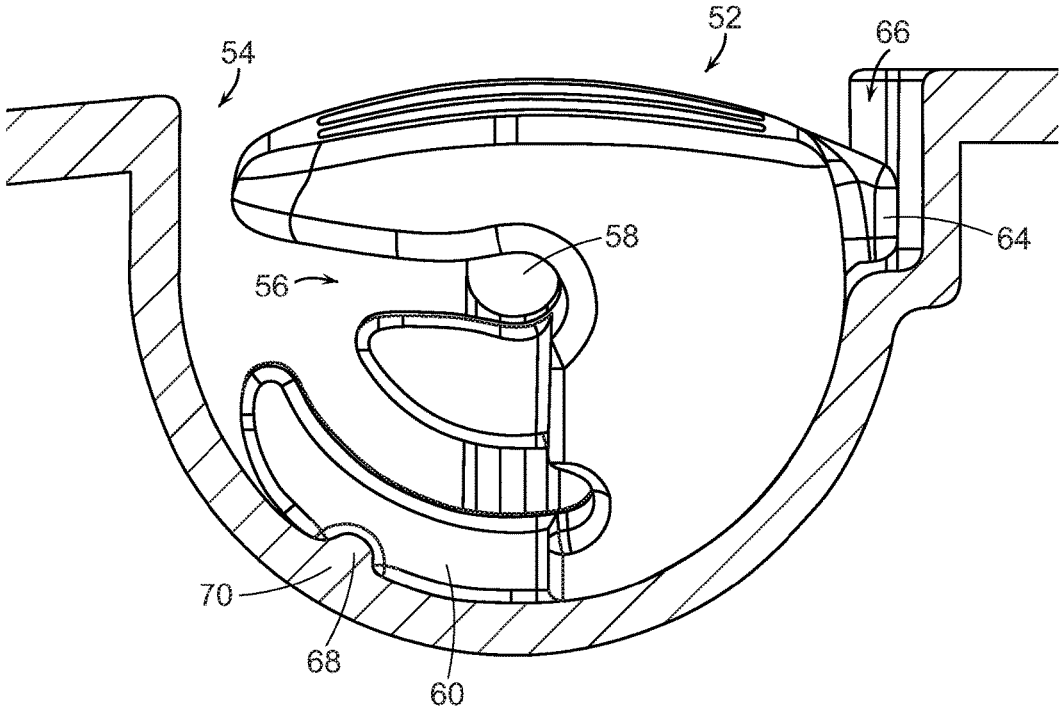
FIG. 9 is another partial cross-sectional view of the golf club head of FIG. 5, illustrating another step in the installation of the movable weight member.
Figure 10:
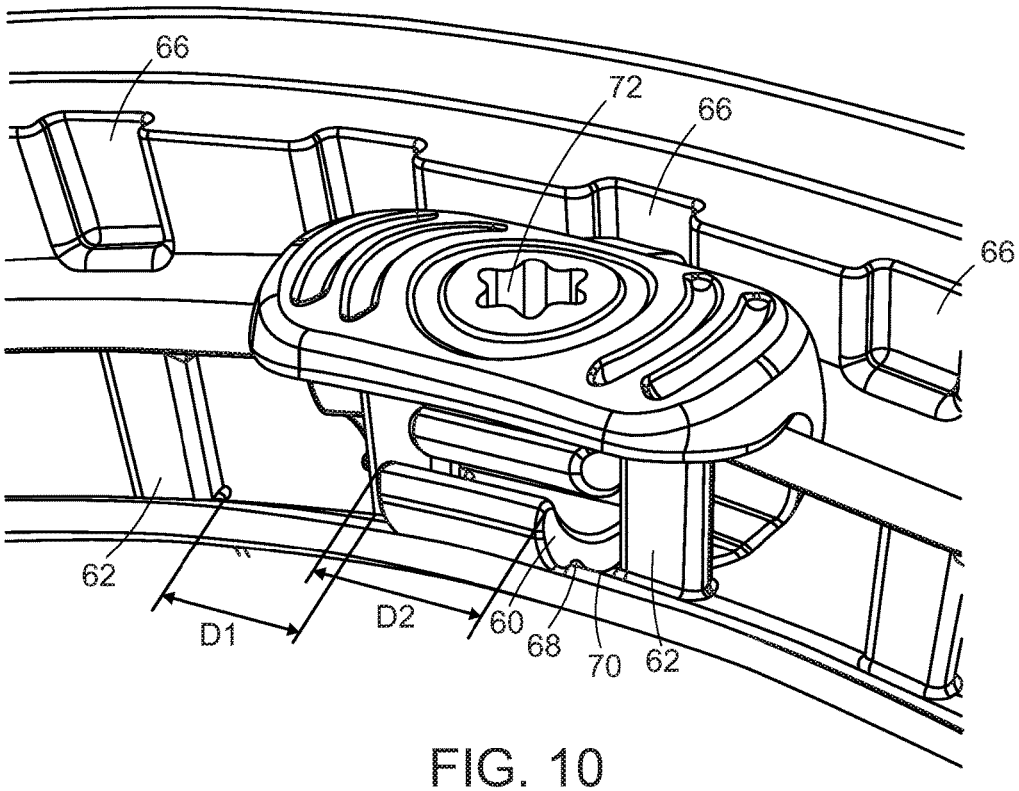
FIG. 10 is a perspective view of a portion of the golf club head of FIG. 5.

The first step during installation of weight member 52 in weight mount 54 is to rotate the weight member 52 so that the slot 56 is aligned with the rail 58 and insert the weight member 52 into the weight mount 54 until the rail 58 is fully received by slot 56. The shape of slot 56 is selected so that there is a press fit between a portion of the slot 56 and the rail 58 before the rail snaps into place through the weight member 52. FIG. 6 shows the weight member 52 in the unlocked orientation after the rail 58 is snapped into the slot 56, with the rail 58 extending through slot 56. In the configuration shown in FIG. 6, the weight member 52 may be slid along the rail 58, as shown in FIG. 7, while the rail supports 62 are sized to slip through the slot 56.

The weight member 52 includes an alignment tab 64 that engages one of a plurality of alignment slots 66 included in the sidewall of the weight mount 54. When the alignment tab 64 is aligned with one of the slots 66, the weight member 52 may be rotated about rail 58 between the locked and unlocked orientations. If the weight member 52 is positioned so that the alignment tab 64 is misaligned with a slot 66, then the weight member 52 is prevented from rotating around the rail 58 toward the locked orientation. The alignment slots 66 assist a user in positioning the weight member 52 so that the lock tab 60 is positioned between rail supports 62 prior to attempting to rotate the weight member 52 toward the locked orientation.

After the alignment tab 64 is aligned with an alignment slot 66, the weight member 52 is rotated toward the locked orientation, as shown in the progression through views FIGS. 5, 6, 8, and 9. During that rotation, a portion of lock tab 60 including a weight locking feature, such as recess 68, contacts a locking portion 67 of the sidewall of the weight mount 54. Further rotation results in the lock tab 60 contacting a ridge 70, which causes the lock tab 60 to deflect relative to the remainder of the body of the weight member. The locking portion 67 is formed by a surface of the sidewall that is curved and that includes a locking feature, such as ridge 70. In the present embodiment, the locking portion includes a portion having a generally constant radius $R_{L1}$ relative to the rail 58 that is adjacent the ridge 70 which defines a radius $R_{L2}$ relative to the rail 58 that has a value less than $R_{L1}$.

Additionally, when the weight member 52 is installed on rail 58 it defines dimensions $R_{W1}$ and $R_{W2}$. Dimension $R_{W1}$ extends from the center of the slot 56 that receives rail 58 to recess 68 of the lock tab 60. Dimension $R_{W2}$ extends from the center of the slot 56 that receives rail 58 to recess 68 of the lock tab 60. Dimensions $R_{W1}$ and $R_{W2}$ change during rotation of the weight member 52 between the unlocked orientation and the locked orientation as a portion of lock tab 60 contacts ridge 70 and lock tab 60 is deflected. In the free state (i.e., before the lock tab 60 abuts the ridge 70) $R_{W2}$ is preferably smaller than $R_{L1}$ so that the lock tab 60 first contacts the locking portion 67 at ridge 70. Additionally, in the free state, $R_{W1}$ is preferably larger than $R_{L2}$ so that the lock tab 60 is deflected by the locking portion and remains deflected when the recess 68 engages the ridge 70 so that the features forcibly abut. As an alternative, and as will be further described below, the locking portion may have a contour that results in the distance between the rail and sidewall varying over a greater portion of the sidewall.

The deflection of the lock tab 60 creates friction between the weight member 52 and the weight mount 54, and that deflection can be used to tune the force required to rotate the weight member 52 into, and out of, the locked orientation where the recess 68 is fully engaged with the ridge 70. Preferably, the force is sufficient to require a user to use a tool that is inserted into a tool engagement feature 72 to fully rotate the weight member 52 into the locked orientation, shown in FIGS. 9 and 10, and to rotate the weight member 52 until the recess 68 disengages the ridge 70 toward the unlocked orientation.

Figure 11:
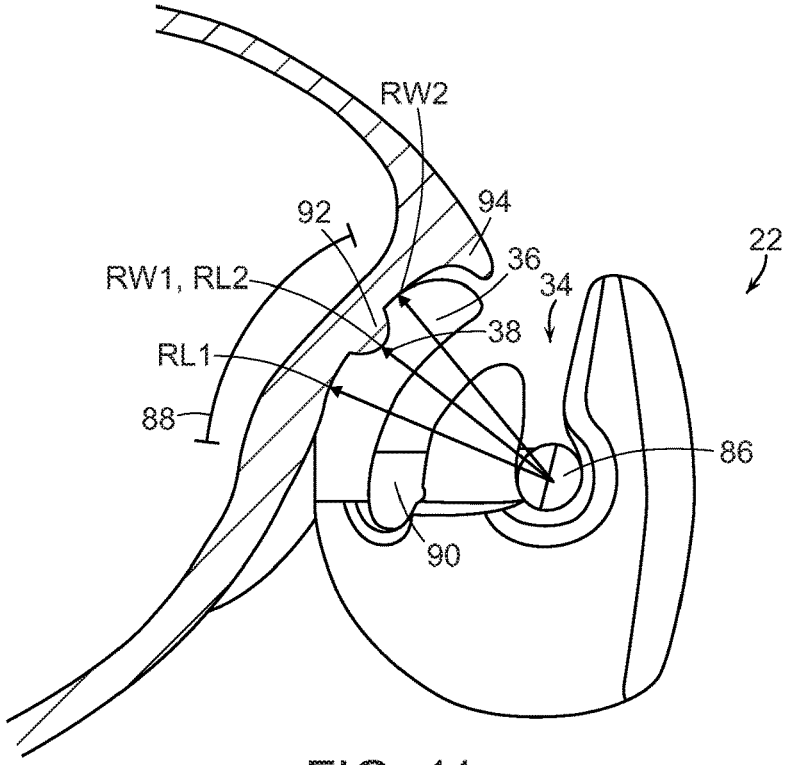
FIG. 11 is a partial cross-sectional view of a portion of another embodiment of a golf club head including a movable weight in accordance with the present invention.

Referring to FIG. 11, another embodiment of a weight mount 84 that is configured to receive the weight member 22, shown in FIGS. 1 and 2, will be described. Weight mount 84 is located on a portion of the golf club head, such as a skirt. In the present embodiment, the sidewall area of weight mount has been reduced, illustrating that the weight member 22, described previously, may be coupled to the golf club head using a weight mount that requires less structure and less mass to construct. The weight mount 84 is generally constructed from a rail 86 cantilevered off of a portion of the golf club head, and a locking portion 88. In the present embodiment, weight mount 84 is formed on a portion of the skirt of a golf club head.

The rail 86 of weight mount 84 extends outward from a portion of the perimeter of the golf club head. The rail 86 is suspended by a plurality of rail supports 26 that are spaced from each other by a predetermined distance D1. In the present embodiment, the rail supports 90 are coupled to the perimeter of the golf club head.

The locking portion 88 is a portion of the perimeter surface of the golf club head that is adjacent rail 86 and rail supports 90. The locking portion 88 is shaped so that the distances between portions of the locking portion 88 and the rail 86 vary over the locking portion 88. The distance between the rail and the locking portion varies to deflect the lock tab 36 of the weight member 22, which allows the weight member 22 to be locked in place. The locking portion 88 also includes a ridge 92 that is received by the recess 38 of the weight member 22, when the weight member 22 is in the locked orientation.

Similar to previous embodiments, the rail 86 and rail supports 90 interact with the weight member 22 to restrict relative motion between the weight member and the weight mount in directions longitudinally along the weight mount, and in a direction generally normal to the weight mount so that the weight member is retained within the weight mount.

Generally, the weight member 22 may be rotated about the rail 86 between an unlocked orientation and a locked orientation. The locking portion 88 of the weight mount 84 defines a first radius $R_{L1}$ from rail 86 at a first portion of the locking portion 88, and a second radius $R_{L2}$ from rail 86 at ridge 90, and $R_{L1}$ is greater than $R_{L2}$. Additionally, the weight member 22 defines dimensions $R_{W1}$ and $R_{W2}$. In general, $R_{W1}$ and $R_{W2}$ extend from the center of the rail to outward portions of the lock tab 36. $R_{W1}$ extends from the center of the cavity that receives the rail 86 to recess 38, and $R_{W2}$ extends from the center of the cavity that receives the rail 86 to the outer surface of an adjacent portion of lock tab 36. Dimensions $R_{W1}$ and $R_{W2}$ change during rotation of the weight member 22 between the unlocked orientation and the locked orientation. In the free state (i.e., before the lock tab 36 abuts the sidewall of the weight mount 84) $R_{W2}$ is preferably smaller than $R_{L1}$ so that the lock tab 36 first contacts the locking portion at ridge 92. Additionally, in the free state, $R_{W1}$ is preferably larger than of $R_{L2}$ so that the lock tab is deflected by the locking portion and remains deflected when the recess 38 engages the ridge 92. In the unlocked orientation, the weight member is movable along the elongate weight mount along the longitudinal axis L by sliding it along the rail. In the locked configuration, a first portion of the weight member is disposed between the spaced rail supports to restrict longitudinal movement of the weight member along the rail, relative to the weight mount.

Additionally, the weight mount 84 may be shaped to prevent the rotation of the weight member 22 past the locked orientation. For example, the locking portion 88 may also include a limit stop 94 that is shaped to limit rotation of the weight member 22. In the present embodiment, the limit stop 94 is configured to abut the end of lock tab 36 when the weight member 22 is rotated past the locked orientation. However, it should be appreciated that a portion of the locking portion may include a dimension between the rail 86 and the locking portion that requires a higher force to rotate than possible by a user.

Figure 12:
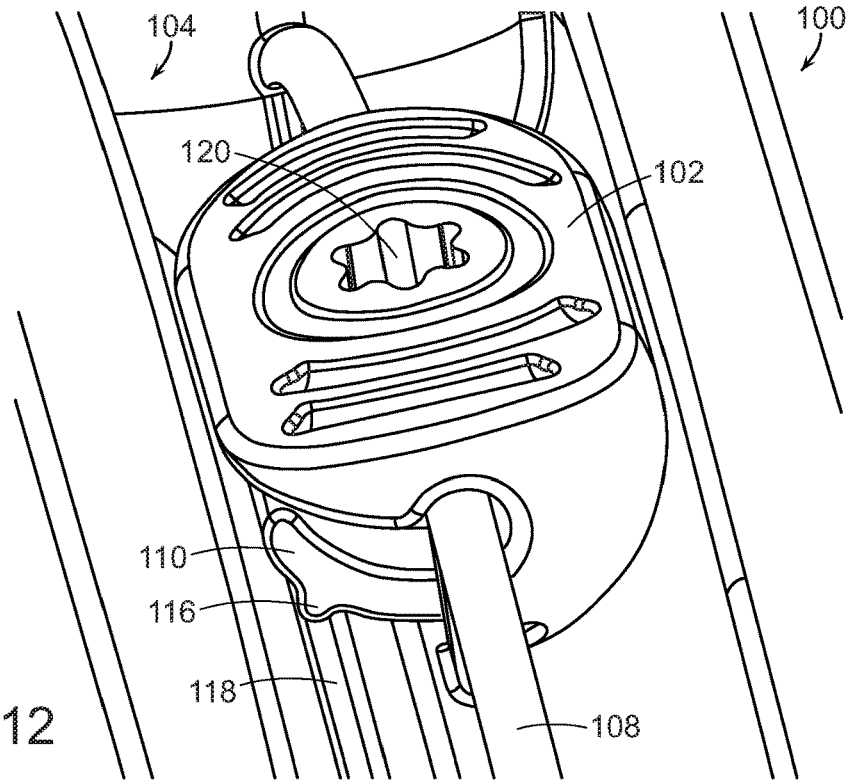
FIG. 12 is a perspective view of a portion of the sole of another embodiment of a golf club head including a movable weight.
Figure 13:
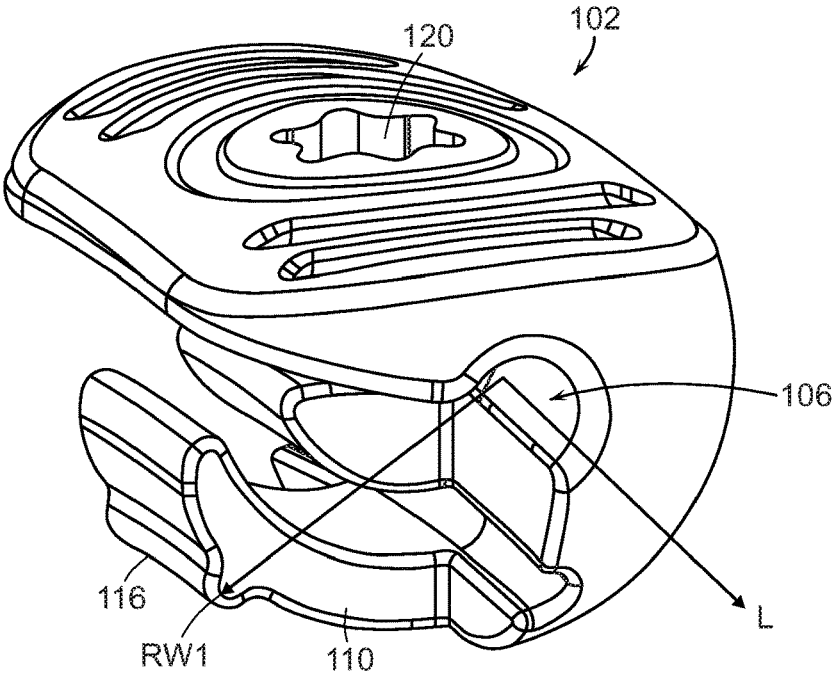
FIG. 13 is a perspective view of the movable weight member of FIG. 12.
Figure 14:
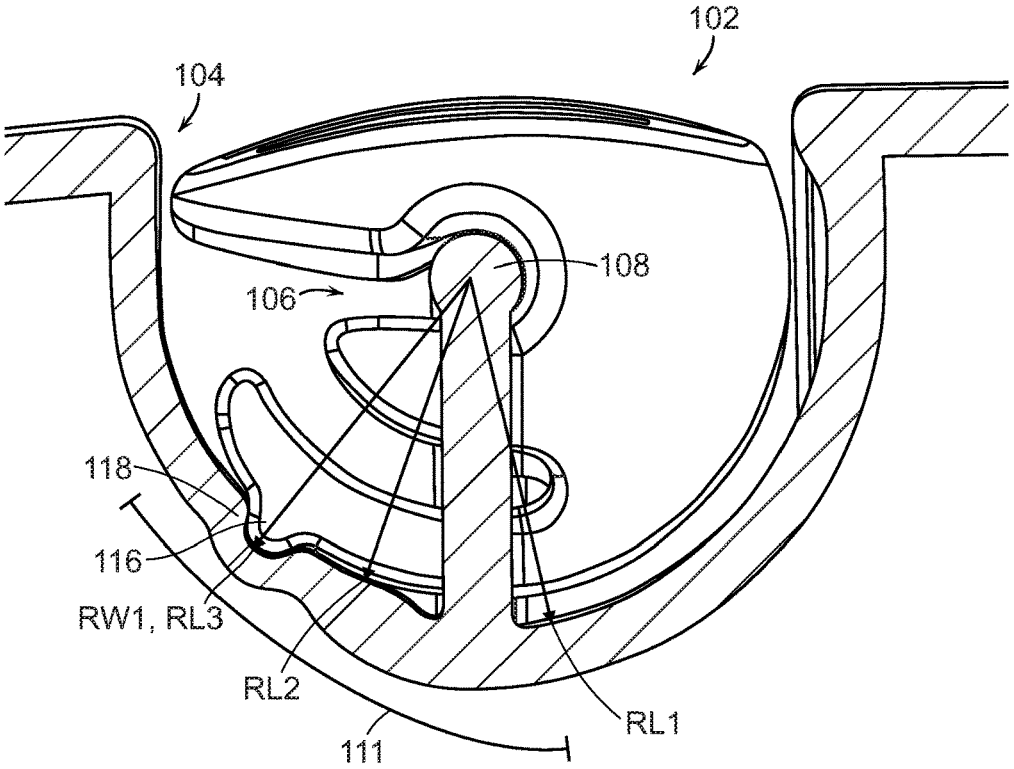
FIG. 14 is a partial cross-sectional view of a portion of the golf club head of FIG. 12.

Referring now to FIGS. 12-14, another embodiment of a weight member according to the present invention will be described. In particular, the present embodiment illustrates an alternative weight locking feature included on a removable weight member. A golf club head 100 includes a movable weight member 102 mounted in a weight mount 104.

The weight member 102 includes a slot 106 that is sized to receive and snap onto a rail 108 in the weight mount 104, and a lock tab 110. The lock tab 110 engages a locking portion of the sidewall of the weight mount 104 to lock the weight member 102 into a location. The lock tab 110 is generally a flexible cantilevered tab defined by a second slot 107, and the lock tab 110 includes a weight locking feature, which in the present embodiment is a ridge 116.

The weight mount 104 is generally constructed from a locking portion 111 and a rail 108. In the present embodiment, weight mount 104 is an elongate recessed channel portion of the golf club head that includes the longitudinal rail 108. The locking portion 111 of the sidewall of the weight mount 104 is a portion that abuts the ridge 116 of the lock tab 110, when the weight member 102 is rotated into the locked orientation, causing the lock tab 110 to deflect. The locking portion includes a mount locking feature that is a recess 118 that forms an elongate channel in the illustrated embodiment.

After the weight member 102 is installed on the rail 108, it may be rotated about the rail 108 to orient it in a locked configuration, shown in FIG. 14, or in an unlocked orientation. During that rotation, the weight locking feature, such as ridge 116, contacts the locking portion 111 of the sidewall of the weight mount 104 and causes the lock tab 110 to deflect relative to the remainder of the body of the weight member 102. Locking portion 111 is formed by a surface of the sidewall that has a contour that results in the distance between the rail 108 and the sidewall that changes over a portion of the sidewall. In particular, the locking portion 111 has a first radius $R_{L1}$ from rail 108 at a first end of the locking portion 111, a second radius $R_{L2}$ at an intermediate location along the locking portion 111, and a third radius $R_{L3}$ at the recess 116. In the illustrated embodiment, $R_{L1}$ is greater than $R_{L3}$, and both $R_{L1}$ and $R_{L3}$ are greater than $R_{L2}$. Additionally, when the weight member 102 is installed on rail 108 it defines a dimension $R_W$ extending from the center of the slot 106 that receives rail 108 to the outward most portion of the lock tab 110 (e.g., at ridge 116). The magnitude of $R_{W1}$ changes during rotation of the weight member 102 between the unlocked orientation and the locked orientation. In the free state (i.e., before the lock tab 110 abuts the sidewall of the weight mount 104) $R_{W1}$ is preferably smaller than $R_{L1}$ so that the ridge 116 first contacts the locking portion 111 at an intermediate location along the locking portion 111. Additionally, in the free state, $R_{W1}$ is preferably larger than each of $R_{L2}$ and $R_{L3}$ so that the lock tab is deflected by the locking portion 111 and remains deflected when the ridge 116 engages the recess 118. Once the weight member is in the locked orientation the dimension $R_{W1}$ is forcibly reduced by forcible abutment of ridge 116 with recess 118.

While it is apparent that the illustrative embodiments of the invention disclosed herein fulfill the objectives of the present invention, it is appreciated that numerous modifications and other embodiments may be devised by those skilled in the art. Additionally, feature(s) and/or element(s) from any embodiment may be used independently or in combination with other embodiment(s) and steps or elements from methods in accordance with the present invention can be executed or performed in any suitable order. Therefore, it will be understood that the appended claims are intended to cover all such modifications and embodiments, which would come within the spirit and scope of the present invention.

What is claimed is:

1. A golf club head, comprising:

a hosel;

a ball striking face;

a sole extending aftward from a lower edge of the ball striking face;

a crown extending aftward from an upper edge of the ball striking face;

a skirt extending between the sole and the crown;

a weight mount disposed on at least one of the sole, the crown and the skirt, the weight mount including a sidewall, an elongate rail, and a mount locking feature disposed on the sidewall, wherein the rail defines a longitudinal axis extending parallel to the rail, wherein the rail is suspended away from the sidewall by a plurality of rail supports, wherein adjacent rail supports are spaced by a distance $D_1$, wherein at each of at least two locations along the rail the weight mount defines a first radial dimension $R_{L1}$ between the center of the rail and the sidewall, and a second radial dimension $R_{L2}$ between the center of the rail and the mount locking feature, wherein a magnitude of $R_{L1}$ is greater than a magnitude of $R_{L2}$; and a weight member that includes a first slot and a second slot, wherein the first slot includes an opening and a cavity that receives the rail at the innermost end of the first slot, wherein the second slot extends into the weight member to define a cantilevered lock tab that has a width $D_2$, wherein the width $D_2$ is less than distance $D_1$ between adjacent rail supports, wherein the lock tab includes an outer surface that defines a weight locking feature, wherein the weight member defines a radial dimension $R_{W1}$ between a center of the cavity and the outermost portion of the weight locking feature, wherein when the weight member is in a free state a magnitude of $R_{W1}$ is greater than the magnitude of $R_{L2}$;

wherein the weight member is rotatable about the rail between an unlocked orientation and a locked orientation, wherein in the unlocked orientation the first slot is aligned with the rail supports so that the weight member is slidable along the rail in the direction of the longitudinal axis of the rail, wherein in the locked orientation the lock tab of the weight member extends into the space defined by adjacent rail supports to prevent movement of the weight member longitudinally along the rail and the lock tab abuts the sidewall of the mount so that the weight locking feature forcibly engages the mount locking feature to prevent rotation of the weight member about the rail, wherein the magnitude of the radial dimension $R_{W1}$ of the weight member changes when the weight member is rotated between the unlocked orientation and the locked orientation such that the magnitude of $R_{W1}$ is smaller when the weight member is in the locked orientation than when the weight member is in the free state.

2. The golf club head of claim 1, wherein the mount locking feature is a projection and the weight locking feature is a recess.

3. The golf club head of claim 2, wherein the weight locking feature is a channel that is recessed across the locking tab, and wherein the mount locking features is an elongate ridge that projects from the sidewall of the weight mount.

4. The golf club head of claim 1, wherein the mount locking feature is a recess and the weight locking feature is a projection.

5. The golf club head of claim 4, wherein the mount locking feature is an elongate channel that is recessed into the sidewall of the weight mount, and wherein the weight locking feature is an elongate ridge that extends across the lock tab.

6. The golf club head of claim 1, wherein the weight mount further comprises a plurality of slots in the sidewall spaced from the mount locking feature, and wherein the weight member further comprises a projection that is sized to fit into each of the plurality of slots in the sidewall, wherein the projection is disposed in one of the plurality of slots when the weight member is oriented between the unlocked orientation and the locked orientation.

7. The golf club head of claim 6, wherein each of the plurality of slots is adjacent a space between rail supports.

8. The golf club head of claim 1, wherein the weight mount is an elongate recess that forms a channel and the rail is suspended from an innermost portion of the sidewall by the rail supports.

9. The golf club head of claim 1, wherein the weight mount is disposed in the skirt.

10. The golf club head of claim 9, wherein the rail is suspended from the skirt by the plurality of rail supports.

11. The golf club head of claim 1, wherein the rail is linear.

12. The golf club head of claim 1, wherein the rail is curved in a single plane.

13. A golf club head, comprising:

a hosel;

a ball striking face;

a sole extending aftward from a lower edge of the ball striking face;

a crown extending aftward from an upper edge of the ball striking face;

a skirt extending between the sole and the crown;

a weight mount disposed on at least one of the sole, the crown and the skirt, the weight mount including a sidewall, an elongate rail, a tool engagement feature, and a mount locking feature disposed on the sidewall that is a ridge that projects from the sidewall of the weight mount, wherein the rail defines a longitudinal axis extending parallel to the rail, wherein the rail is suspended away from the sidewall by a plurality of rail supports, wherein adjacent rail supports are spaced by a distance $D_1$, wherein at each of at least two locations along the rail the weight mount defines a first radial dimension $R_{L1}$ between the center of the rail and the sidewall, and a second radial dimension $R_{L2}$ between the center of the rail and the ridge, wherein a magnitude of $R_{L1}$ is greater than a magnitude of $R_{L2}$; and a weight member that includes a first slot and a second slot, wherein the first slot defines an opening and a cavity that receives the rail at the innermost end of the first slot, wherein the second slot extends into the weight member to define a cantilevered lock tab that has a width $D_2$, wherein the width $D_2$ is less than distance $D_1$ between adjacent rail supports, wherein the lock tab includes an outer surface that defines a weight locking feature that is an elongate recess that extends across the lock tab, wherein the weight member defines a radial dimension $R_{W1}$ between a center of the cavity and the outermost portion of the weight locking feature, wherein when the weight member is in a free state a magnitude of $R_{W1}$ is greater than the magnitude of $R_{L2}$;

wherein the weight member is selectively rotatable about the rail between an unlocked orientation and a locked orientation, wherein in the unlocked orientation the first slot is aligned with the nearest rail supports so that the weight member is slidable along the rail in the direction of the longitudinal axis of the rail, wherein in the locked orientation the lock tab of the weight member extends into the space defined by adjacent rail supports to prevent movement of the weight member longitudinally along the rail and the lock tab abuts the sidewall so that the weight locking feature forcibly engages the mount locking feature to prevent rotation of the weight member about the rail, wherein the magnitude of radial dimension $R_{W1}$ of the weight member changes when the weight member is rotated between the unlocked orientation and the locked orientation such that the magnitude of $R_{W1}$ is smaller when the weight member is in the locked orientation than when the weight member is in the free state.

14. The golf club head of claim 13, wherein the weight mount further comprises a plurality of slots in the sidewall, and wherein the weight member further comprises a projection that is sized to fit into each of the plurality of slots in the sidewall, wherein the projection is disposed in one of the plurality of slots when the weight member is oriented between the unlocked orientation and the locked orientation.

15. The golf club head of claim 14, wherein each of the plurality of slots is adjacent a space between rail supports.

16. The golf club head of claim 13, wherein the weight mount is an elongate recess that forms a channel and the rail is suspended from an innermost portion of the sidewall by the rail supports.

17. The golf club head of claim 13, wherein the weight mount is disposed in the skirt.

18. The golf club head of claim 17, wherein the rail is suspended from the skirt by the plurality of rail supports.

* * * * *